United States Patent [19]

Read

[11] 4,336,962

[45] Jun. 29, 1982

[54] ADJUSTABLE LIFTING TONG

[76] Inventor: Owen R. Read, R.F.D. #1, Box 110, Chepachet, R.I. 02814

[21] Appl. No.: 200,531

[22] Filed: Oct. 24, 1980

[51] Int. Cl.[3] ..... B66C 1/00

[52] U.S. Cl. ..... 294/106; 294/81 R; 294/67 BB

[58] Field of Search ..... 294/106, 67 R, 91 R, 294/82 R, 81, 88, 113, 115, 67 BB, 27, 28, 30, 31

[56] References Cited

U.S. PATENT DOCUMENTS

| | | | |
|---|---|---|---|
| 2,857,193 | 10/1958 | Keppenstall | 294/106 |
| 3,469,879 | 9/1969 | Tezuka | 294/106 |
| 3,572,801 | 3/1971 | Howard et al. | 294/67 R |
| 3,771,825 | 11/1973 | Yamada et al. | 294/106 |

*Primary Examiner*—James B. Marbert

*Attorney, Agent, or Firm*—William Frederick Werner

[57] ABSTRACT

Means for lifting and rotating a package ninety degrees in lifted position, in a height limiting environment, rather than a scissor type tong environment.

4 Claims, 12 Drawing Figures

ADJUSTABLE LIFTING TONG

STATEMENT OF INVENTION

This invention relates to a lifting tong for use in a height limiting environment where the material to be lifted must be grasped with delicate pressure and rotated ninety degrees from lifted to set-down position.

PRIOR ART

This invention is an improvement over U.S. Pat. Nos. 2,060,722 dated Nov. 10, 1936; 2,874,990 dated Feb. 24, 1959; 3,010,751 dated Nov. 28, 1961 and 3,572,801 dated Mar. 30, 1971 and generally relates to lifting tongs which lift a carton off a conveyor and simultaneously permits the carton to be swung through an arc of ninety degrees to a position upon a pallet.

Lifting tongs have found use in the storage and transportation of goods where goods are palletized and shipped through with the pallet to their destination. A drawback to the prior art devices is that they cannot lift goods upwardly and simultaneously permit the goods to be moved through a ninety-degree arc, with tongs which are adjustable toward and away from each other; the tongs grasping the package with a force which does not destroy the integrity of the side of a corrugated container.

OBJECTS OF THE INVENTION

It is a primary object of this invention to provide a lifting tong with tongs adjustable toward and away from each other and therefore adjustable in the amount of gripping force exerted by the tongs on the object to be lifted.

It is another object of this invention to improve the utilitarian use of a lifting tong.

It is a further object of the invention to lift a package with a deft grip and to permit the package to be manually pivoted ninety degrees.

Other objects of the present invention will become apparent in part and be pointed out in part in the following specification and claims.

DESCRIPTION OF THE PREFERRED EMBODIMENT

Figures 1, 2, 3, 6, 7, 8:
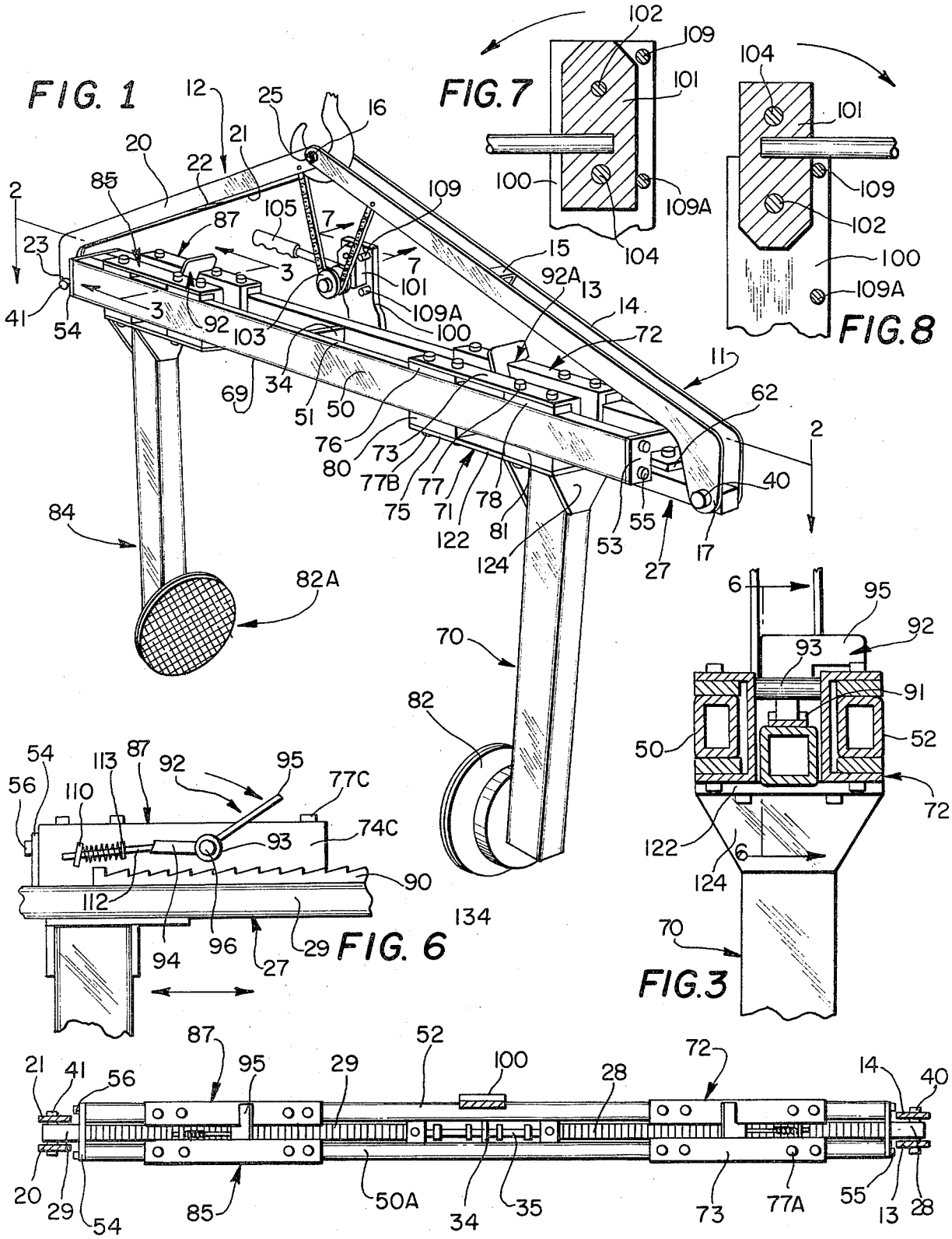
FIG. 1 is a front perspective view in open position of the new and improved adjustable lifting tong.
FIG. 2 is a plan view partly in section, taken along lines 2—2 of FIG. 1.
FIG. 3 is a vertical cross section, taken on line 3—3 of FIG. 1.
FIG. 6 is a fragmentary side elevational view of latching mechanism in released position.
FIG. 7 is a fragmentary sectional view, taken on line 7—7 of FIG. 1, showing the clamping lever in open position.
FIG. 8 is a fragmentary sectional view, showing the clamping lever of FIG. 7 in closed position.

In proceeding with this invention, reference is made to the drawing, wherein is illustrated the new and improved adjustable lifting tong.

With particular reference to all the Figures, the structure shown comprises link members, generally indicated by reference numerals 11 and 12. Link member 11 comprises two parallel plates 13, 14 held in spaced relation by blocks 15 fastened to plates 13, 14 as by welding. Plates 13, 14 are provided with registered openings 16, 17 at opposite ends.

In like manner, link member 12 comprises two parallel plates 20, 21 held in spaced relation by blocks 22 fastened to plates 20, 21 as by welding. Plates 20, 21 are provided with registered openings 23, 24 at opposite ends. A stud 25 extends through registered openings 16, 24.

A thrust bar, generally indicated by reference numeral 27, comprises two hollow horizontal right side 28 and left side 29, sections. A right side bushing 30 is fastened to the inside wall 31 of right side 28. A left side bushing 32 is fastened to the inside wall 31 of left side 29. A slide rod 33 fastened to a brace 34 is provided to slidably mount bushings 30, 32 thereon. a stop post 35 provided with screw threads 36, 37 on opposite ends is fastened to bracket 34. A right side right angle bracket 38 provided with an orifice is fastened to right side 28 with stop post 35 mounted in said orifice. A stop nut 36A is mounted upon threads 36. Similarly, a left side right angle bracket 39 provided with an orifice is fastened to left side 29 with stop post 35 slidably mounted in said last mentioned orifice. A stop nut 37A is mounted upon threads 37. A bore (FIG. 2) is provided in the outboard end of horizontal right section 28. An axel 40 is mounted in said bore and in registered openings 17 to pivotally mount the right side section 28 of thrust bar 27 to link member 11. Similarly, a bore is provided in the outboard end of horizontal left section 29. An axel 41 is mounted in said bore and in registered openings 23 to pivotally mount the left side section 29 of thrust bar 27 to link member 12.

A front horizontal rail 50 and a rear horizontal rail 52 are held in parallel spaced relation by means of a right end plate 53 and a left end plate 54. Cap screws 55 fasten end plate 53 to rails 50, 52. Cap screws 56 fasten end plate 54 to rails 50, 52. End plates 53, 54 are provided with recessed walls 60, 61, respectively. A bearing block 62 provided with a bearing surface 63 is fastened to end plate 53 as by welding. End plate 54 is similarly provided with a bearing block and bearing surface. Bearing surfaces 63 lay upon thrust bar 27, for purposes which will presently appear.

Attention is directed to FIGS. 1, 4, 5 and 10 wherein is shown a gripping leg 70. The leg 70 consists of a column 120. A flat plate 122 provided with four bolt holes 123 is placed upon the top of column 120. A flange 124 is fastened to column 120 and the end of flat plate 122 as by welding to fasten plate 122 to column 120. A flange 125 is fastened to column 120 and to plate 122 as by means of welding.

A left side right end jaw, generally indicated by reference numeral 71, and a right side right end jaw, generally indicated by reference numeral 72 lay upon flat plate 122 and are fastened thereto by cap screws 129. Jaw 71 consists of top 73, back 74 and bottom 75 and encompasses front horizontal rail 50. A front left top bearing block 76 is interposed between top 73 and the top 51 of front rail 50. Cap screws 77 fasten block 76 to top 73. A front right top bearing block 78 is interposed between top 73 and the top 51 of front rail 50. Cap screws 77 fasten block 78 to top 73. A lower front left bearing block 80 is interposed between bottom 75 of jaw 71 and the base 69 of front rail 50. Cap screws 77 fasten block 80 to bottom 75. A lower front right bearing block 81 is interposed between bottom 75 and the base 69 of front rail 50. Cap screws 77 fasten block 81 to bottom 75.

In like manner, right side right end jaw 72 is similarly constructed. Reference numerals on jaw 72, corresponding to similar parts on jaw 71, will have the suffix "A" added thereto.

Figure 11:
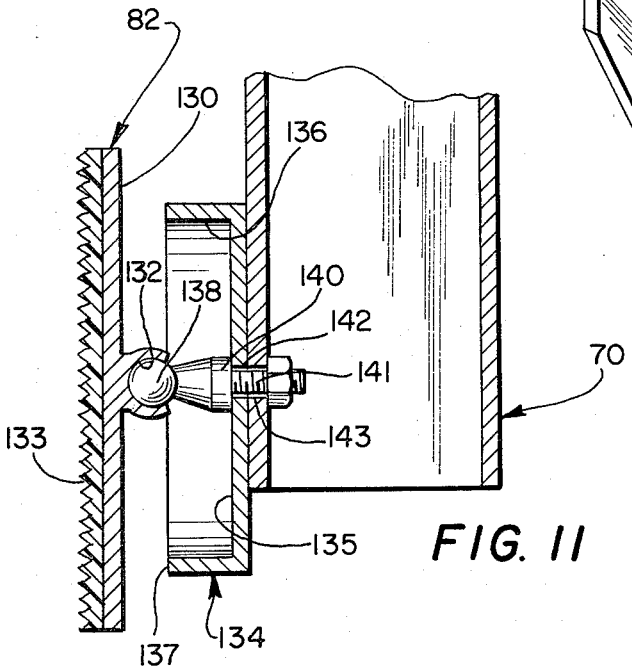
FIG. 11 is a horizontal sectional view, taken on line 11—11 of FIG. 1.
Figure 12:
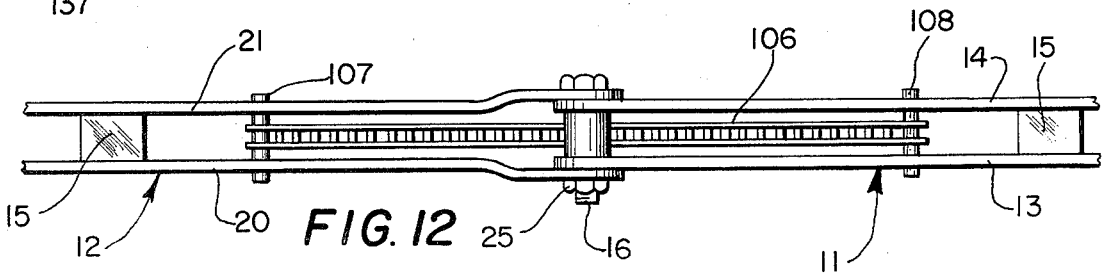
FIG. 12 is a fragmentary plan view of the link members.

A pressure pad, generally indicated by reference numeral 82 (see FIGS. 1 and 11) is provided with a body 130 having a boss 131 provided with a socket 132 and a gripping face 133. A circular stop, generally indicated by reference numeral 134 consists of a base 135 having an upstanding wall 136 provided with a stop surface 137. A ball 138 attached to a stud 140 having a threaded leg 141 is seated in socket 132 to provide a ball and socket joint. Stud 140 passes through clearance orifices 142, 143 provided in base 135 and leg 70, respectively, and fastens circular stop 134 to leg 70 by means of a nut 144 fastened to threaded leg 141. In this manner, pressure pad 82 is loosely or wobbily connected to leg 70 and is free to canter against stop surface 137. Pressure pad 82 and gripping material 133 are self adjusting when forced into contact with a package to be lifted.

In like manner, leg 84 is provided with a self-adjusting pressure pad 82A. The construction of pressure pad 82A is similar to the construction of pressure pad 82. The suffix "A" is added to the part in the structure of pressure pad 82A corresponding to the similar part in pressure pad 82.

A gripping leg 84 is constructed as described for gripping leg 70. Reference numerals on leg 84 correspond to similar parts on leg 70, will have the suffix "A" added thereto. A left side left end jaw, generally indicated by reference character 85, which encompasses front horizontal rail 50. Jaw 85 is similar to jaw 71 in construction. Reference numerals on jaw 85 corresponding to similar parts on jaw 71 will have the suffix "B" added to the jaw 71 reference numerals.

In like manner, a right side left end jaw, generally indicated by reference character 87, encompasses rear horizontal rail 52. Jaw 85 is similar to jaw 71 in construction. Reference numerals on jaw 85 corresponding to similar parts on jaw 71 will have the suffix "C" added to the jaw 71 reference numerals.

Left side section 29 or thrust bar 27 is provided with a bar 90 having ratchet teeth 91. A pawl, generally indicated by reference numeral 92, consists of a hub 93, a short arm 94 and a finger 95. A pintel 96, fastened to back 74C, pivotally mounts hub 93 to back 74C. An arm 110, provided with an elongated slot 111, is fastened to back 74C. A plunger 112 is housed in slot 111. A washer 113 is fastened to plunger 112. A coil spring surrounds plunger 112 and is interposed between washer 113 and arm 110. The end 114 of plunger 112 engages the end 115 of short arm 94 in a manner to provide a resilient hinge contact.

Right side section 28 is provided with a bar 90A having ratchet teeth 91A. A pawl, generally indicated by reference numeral 92A consists of a hub 93A, a short arm 94A and a finger 95A. A pintel 96A, fastened to back 74A, pivotally mounts hub 93A to back 74A.

A bracket 100 is fastened to rear horizontal rail 52 as by welding. A lever arm 101 is pivotally connected to bracket 100 by means of a bolt 102. A chain pulley 103 is rotatably connected to bracket 100 through stub shaft 104. A handle 105 is fastened to bracket 100 to assist in pivoting lever arm 101 from a down position shown in FIGS. 1 and 4 to an up position shown in FIG. 5. A link chain 106 has one end fastened to a pin 107 secured in plates 20, 21 and the other end fastened to a pin 108 secured in plates 13, 14 with the medial area of the chain engaging chain pulley 103. With reference to FIGS. 4, 5, 7 and 8; bracket 100 is provided with an upper stop 109 and a lower stop 109A. When lever arm 101 is in "down" position, FIG. 4, it abuts stop 109A. When lever arm 101 is in "up" position it abuts stop 109 (see FIGS. 7 and 8).

Figure 4:
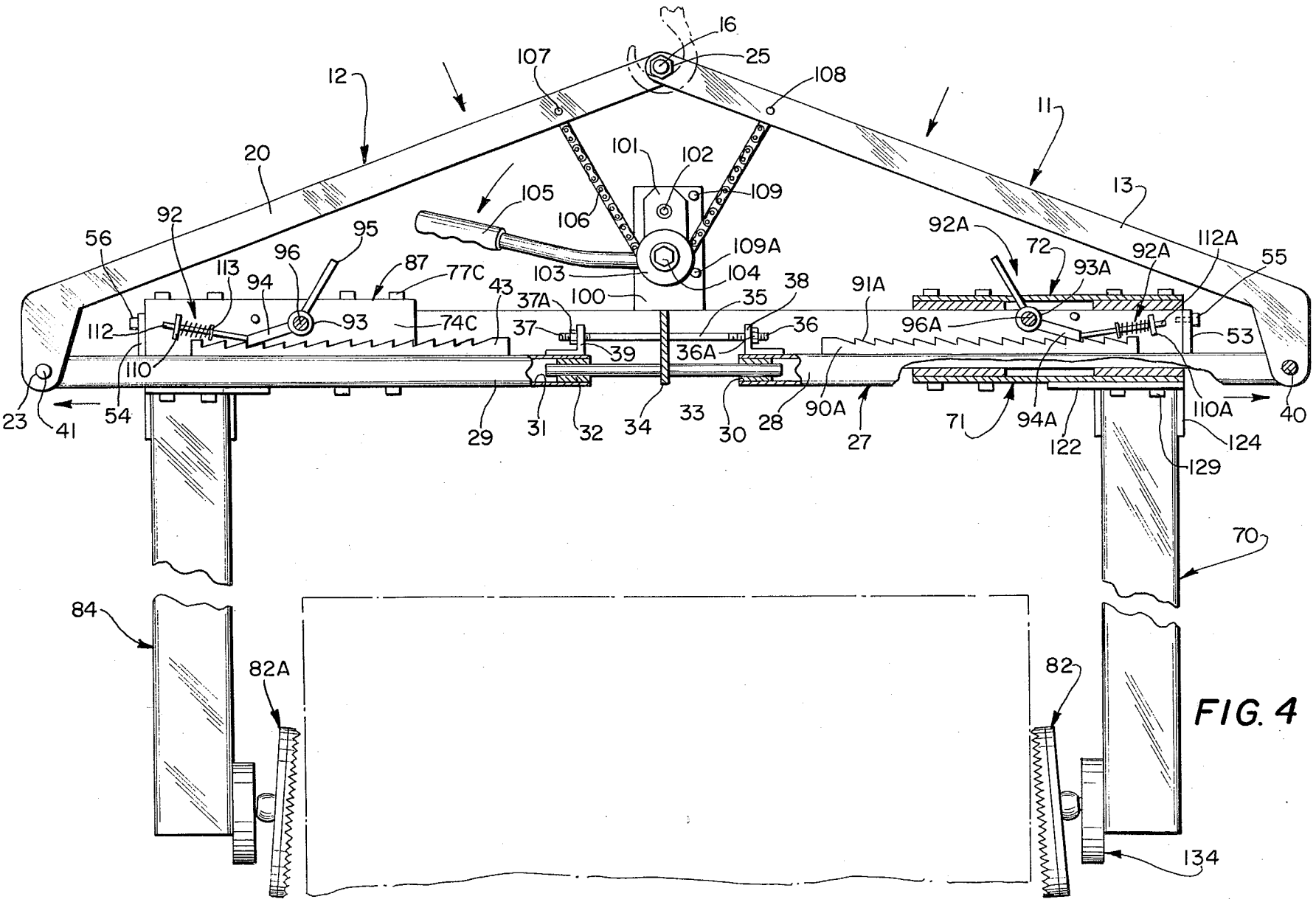
FIG. 4 is a front elevational view, with parts broken away for clarity, showing the mechanism in open position.
Figure 5:
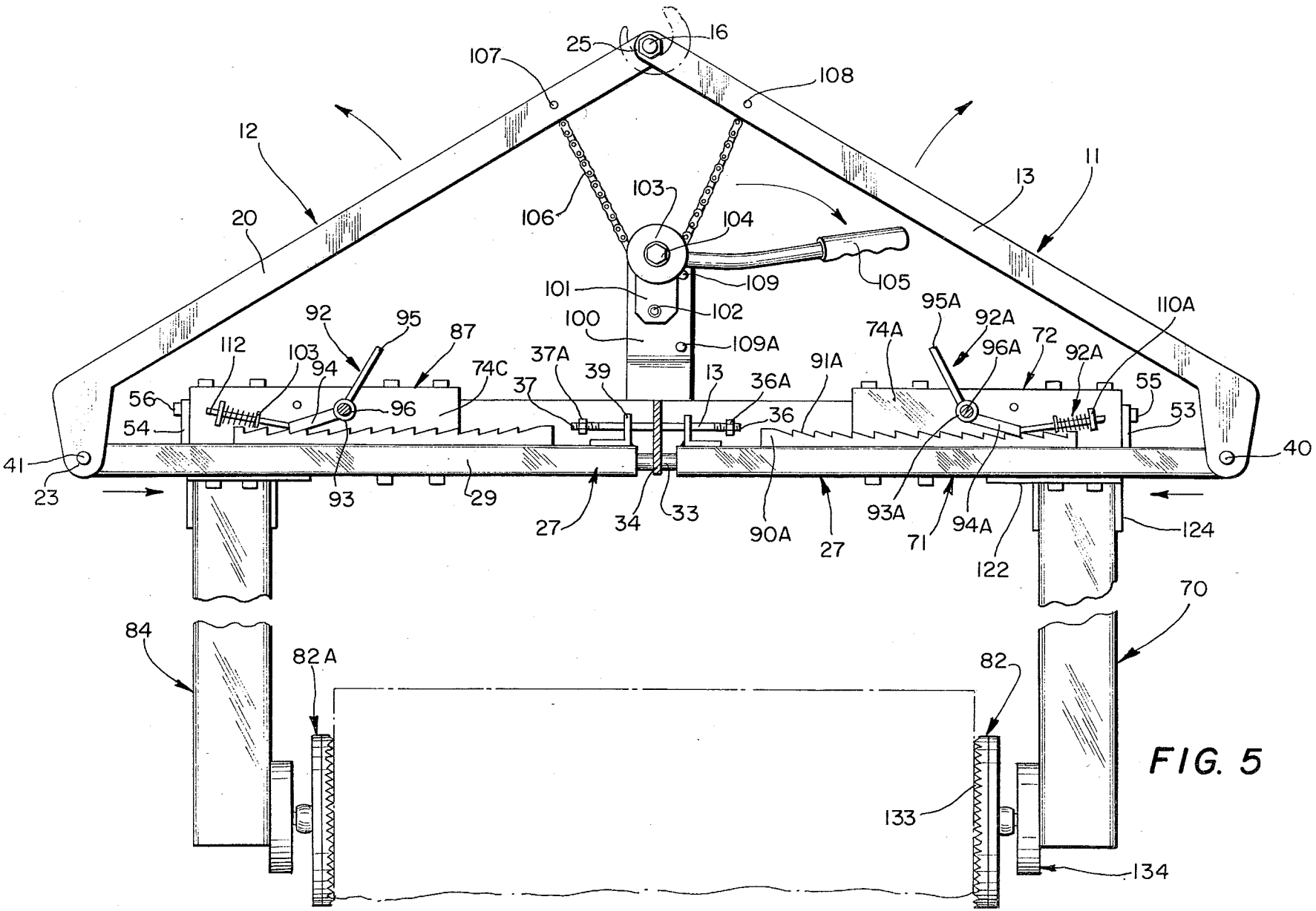
FIG. 5 is a view similar to FIG. 4, with the mechanism in closed position.
Figure 9:
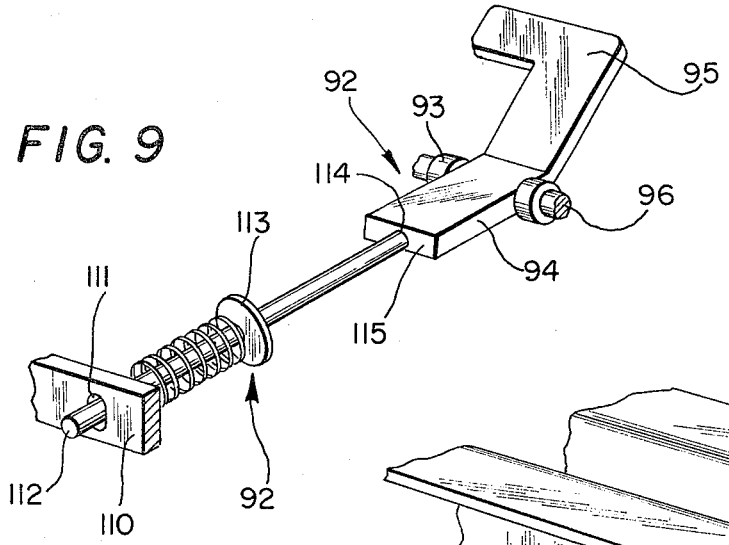
FIG. 9 is a fragmentary perspective view of a pawl assembly.
Figure 10:
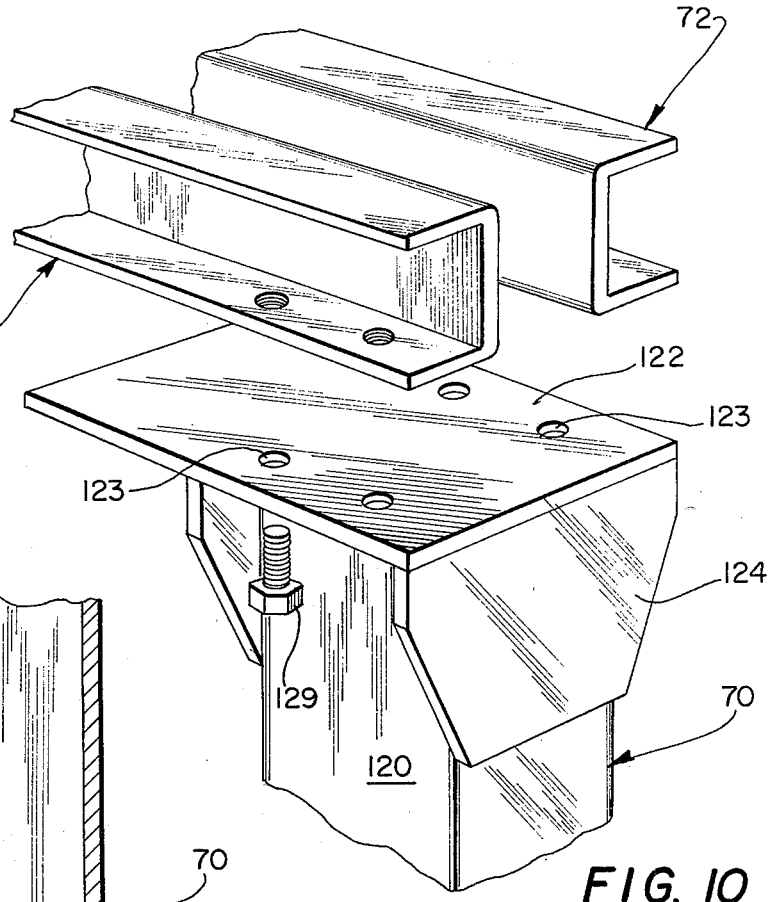
FIG. 10 is a fragmentary perspective view of the left side right end jaw, the right side right end jaw and a leg.

In operation, pivoting handle 105 from the position shown in FIG. 4 to the position shown in FIG. 5 causes link members 11 and 12 to pivot around stud 25 and move upwardly, thereby causing the other end of link member 11 and 12 to pivot around axials 40, 41, respectively, thereby moving sections 28, 29 of thrust bar 27 toward each other and therefore pressure pads 82, 82A into package gripping position. The relative distance between pressure pads 82, 82A from open to package gripping position is determined by the adjustment of pawls 92, 92A with ratchet teeth 91, 91A, respectively, whereby left side right end jaw 71 and right side right end jaw 72 are horizontally adjusted along ratchet teeth 91A, thereby controlling the position of leg 70 in open position. Similarly, left side left end jaw 85 and right side left end jaw 87 are horizontally adjusted along ratchet teeth 91, thereby controlling the position of leg 84 in open position.

A safety feature is provided. As shown in FIG. 4, bracket 38 restrained by nut 36A prevents horizontal right side 28 and bushing 30 from sliding off of slide rod 33. Similarly, bracket 39 restrained by nut 37A prevents horizontal left side 29 and bushing 32 from sliding off of slide rod 33.

Pivotal movement of handle 105 from the position shown in FIG. 5 to the position shown in FIG. 4 causes legs 70, 84 to move away from each other into open or non-gripping position.

Brackets 38, 39 limit the maximum adjusted distance pressure pads 82, 82A move away from each other and therefore the distance between them for receiving a package.

Having shown and described a preferred embodiment of the present invention by way of example, it should be realized that structural changes could be made and other examples given without departing from either the spirit or scope of this invention.

What I claim is:

1. An adjustable lifting tong comprising a thrust bar consisting of a right side section and a left side section, a bracket, a slide bar fastened to said brace and extending on opposite ends, respectively, into said right side section and left side section to support sliding movement of said right end section and left end section toward and away from each other, a right side link member and a left side link member, a stud, means pivotally connecting said right side link member and said left said link member to said stud, a right side axial, means pivotally connecting said right side section and said right side link member to said right side axel, a second axial means pivotally connecting said left side section and said left side link member to said second axial, a front horizontal rail, a rear horizontal rail, a right end plate securing said front rail and said rear rail in spaced relation, a left end plate securing said front rail and said rear rail in spaced relation on the end opposite said right end plate, a first bearing means fastened to said right end plate and interposed between said right end plate and said right side section, a second bearing means fastened to said left end plate and interposed between said left end plate and said left side section, means fastening said brace to said front horizontal rail and said rear horizontal rail, said right side section having right side ratchet teeth, said left side section having left side ratchet teeth, a right side gripping leg having a left side right end jaw slidably mounted upon said front horizontal rail, and a right side right end jaw slidably mounted upon said rear horizontal rail, a left side gripping leg having a left side left end jaw slidably mounted upon said front horizontal rail, and a right side left end jaw slidably mounted upon said rear horizontal rail, a right side pawl pivotally mounted between said left side right end jaw and said right side right end jaw, resilient means resiliently holding said pawl in engagement with said right side ratchet teeth, a left side pawl pivotally mounted between said left side left end jaw and said right side left end jaw, a second resilient means resiliently holding said left side pawl in engagement with said left side pawl, a bracket fastened to said rear horizontal rail, a lever arm pivotally mounted to said bracket, a chain pulley pivotally connected to said lever arm, a handle fastened to said lever arm and a chain fastened on one end to said right side link member and on the other end to said left side link member with the medial arm of said chain engaging said chain pulley, whereby pivotal movement of said handle slidably moves said right hand section and said left hand section towards and away from each other and the, respectively, attached right side gripping leg and left side gripping leg toward and away from each other, simultaneously.

2. Apparatus as set forth in claim 1 wherein said bracket is provided with an upper stop and a lower stop to limit the arc of rotation of said lever arm.

3. Apparatus as set forth in claim 1 wherein a stop post provided with threaded opposite ends is medially fastened to said brace, two stop nuts, one for each threaded opposite end, a right side angle bracket provided with an orifice, means fastening said right side angle bracket to said horizontal right side with said stop post projecting through said orifice, a left side angle bracket provided with an orifice, means fastening said left side angle bracket to said horizontal left side with said stop post projecting through said last mentioned orifice, whereby movement of said right side section with a bar having ratchet teeth and said left side section with a bar having ratchet teeth, abut said two stop nuts, respectively, to limit movement away from each other and thereby the distance between said right side gripping leg and said left side gripping leg.

4. Apparatus as set forth in claim 1, wherein said right side gripping leg and said left side gripping leg are each provided with a pressure pad comprising a body having a boss provided with a socket and a gripping face, a stop having a base provided with a clearance orifice and an upstanding wall having a stop surface, a stud having a ball on one end and threads on the opposite end, said ball seated in said socket to provide a ball joint, said gripping leg having a clearance orifice, the threads passing through said first mentioned clearance orifice and said second mentioned clearance orifice, and a nut rotatably mounted upon said threads to fasten said stop to said gripping leg.

* * * * *